US006443045B1

(12) United States Patent
Kohltsedt et al.

(10) Patent No.: US 6,443,045 B1
(45) Date of Patent: Sep. 3, 2002

(54) RAMMER FOR AN ARTILLERY PIECE

(75) Inventors: Michael Kohltsedt, Immenhausen; Arno Borner, Gudensberg; Karl Lieberum, Niedenstein, all of (DE)

(73) Assignee: Kraus-Maffei Wegmann GmbH & Co. KG, Kassel (DE)

( * ) Notice: Subject to any disclaimer, the term of this patent is extended or adjusted under 35 U.S.C. 154(b) by 0 days.

(21) Appl. No.: 09/533,129

(22) Filed: Mar. 23, 2000

(30) Foreign Application Priority Data

Mar. 31, 1999 (DE) ..... 199 14 663

(51) Int. Cl.[7] ..... F41A 3/78
(52) U.S. Cl. ..... 89/47; 89/45; 89/198
(58) Field of Search ..... 89/47, 45, 46, 89/33.05, 198

(56) References Cited

U.S. PATENT DOCUMENTS 3,884,119 A * 5/1975 Zouck ..... 89/45
4,957,028 A * 9/1990 Lieberum et al. ..... 89/45

FOREIGN PATENT DOCUMENTS

CH 664627 * 3/1988 ..... 89/47

* cited by examiner

*Primary Examiner*—Stephen M. Johnson
(74) *Attorney, Agent, or Firm*—Chadbourne & Parke, LLP

(57) ABSTRACT

A rammer for an artillery piece with a barrel that can be elevated. The rammer has a cradle upstream of the barrel. The cradle is aligned with the powder chamber, has an accommodation for the shell, travels subject to a guide along a track that parallels the axis of the barrel, is coupled to a piston-and-cylinder mechanism that accelerates it toward the barrel, and is provided with a brake. The piston-and-cylinder mechanism is controlled by pneumatic controls that accommodate a rapid-opening valve. The valve diverts air back and forth between a source of compressed air and a vent. There is a pressure-reduction component with an electrically controlled proportional pressure-regulation valve between the source of compressed air and the rapid-opening valve. Signals from a fire direction system or position generator are forwarded to the electric controls. The pressure-regulation valve is then activated, reducing the ramming pressure in accordance with a prescribed formula as elevation decreases.

8 Claims, 4 Drawing Sheets

RAMMER FOR AN ARTILLERY PIECE

BACKGROUND OF THE INVENTION

The present invention concerns a rammer for an artillery piece with a barrel that can be elevated. The rammer has a cradle upstream of the barrel. The cradle has an accommodation for the shell aligned with the powder chamber, travels subject to a guide along a track that parallels the axis of the barrel, is coupled to a piston-and-cylinder mechanism that accelerates it toward the barrel, and is provided with a brake that brakes it at a prescribed distance upstream of the end of the barrel. The shell accommodation has a structure at the upstream end that engages the shell. The piston-and-cylinder mechanism is controlled by pneumatic controls that accommodate a rapid-opening valve. The valve diverts air back and forth between a source of compressed air and a vent.

A shell rammer of this type is described in EP 0 352 584 B1. Known rammers of this type are operated at a constant ramming pressure of 25 bars for example over the total range of elevation (−2.5 to +65). At lower elevations this leads to unnecessarily high stress on both the rammer and the shell.

Furthermore, the shell-ramming forces are highly dependent on elevation, and increase considerably as elevation decreases. This situation can cause damage and can be a detriment to the precision of the ramming process.

SUMMARY OF THE INVENTION

The object of the present invention is an improved version of the aforesaid generic shell rammer wherein the ramming forces will not increase as rapidly when the elevation decreases and that will accordingly lack the aforesaid drawbacks.

This object is attained in accordance with the present invention by a pressure-reduction component with an electrically controlled proportional pressure-regulation valve between the source of compressed air and the rapid opening valve. Signals from a fire-direction system or position generator are forwarded to the electric controls. The pressure-regulation valve is then activated, reducing the ramming pressure in accordance with a prescribed formula as elevation decreases.

Advantageous advanced embodiments of the present invention will be specified hereinafter.

The theory behind the present invention is to reduce the ramming pressure acting on the piston-and-cylinder mechanism as elevation decreases and accordingly ensure that the ramming speeds remain within a prescribed range at different elevations.

It has been demonstrated that specific prescribed formulas representing the relationship between elevation and ramming pressure or ramming speed can be exploited to attain ramming forces as identical as possible over the total range of elevation. An attempt is made to ensure that the ramming speed determined at the maximal elevation and at the maximal ramming pressure established for that elevation will be maintained for the ramming process throughout the range of elevation.

Kinematics demonstrates that the formula for reducing ramming pressure or ramming speed as elevation decreases can be closely approximated by the equation $$V_{ram}=A+B\cdot E-C\cdot E^2-D\cdot E^3$$

wherein $V_{ram}$ is the ramming speed in m/sec, E the angle of elevation in degrees, and

A=5.3–5.8

B=0.0516

C=0.000019

D=0.0000035, are mathematically and empirically determined constants.

Calculations and testing have revealed that the most effective value for the dependence of ramming pressure on elevation is represented by the equation $$P_{ram}=12.6+0.3E-0.000193\cdot E^2-0.000012\cdot E^2$$

One embodiment of a shell rammer in accordance with the present invention will now be specified with reference to the accompanying drawing, wherein

DETAILED DESCRIPTION OF THE INVENTION

Figure 1:
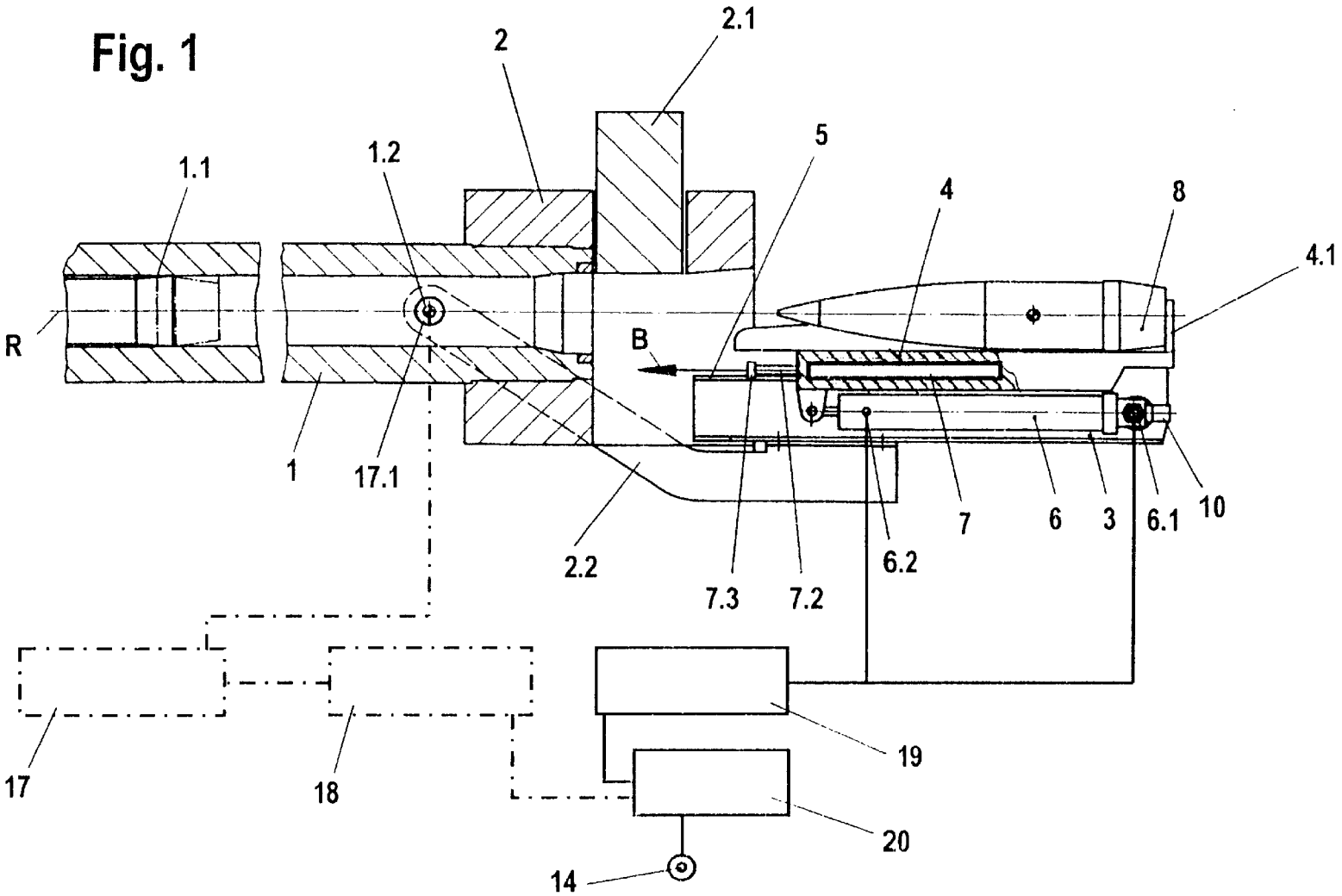
FIG. 1 is a highly schematic illustration of a longitudinal section through the upstream end of the barrel of an artillery piece with a shell rammer accommodated therein.

The breach at the upstream end of the barrel 1, illustrated in FIG. 1, of an otherwise unillustrated artillery piece is provided with a block 2 and a wedge 2.1. There is a tapering transition 1.1 at the shell-ramming point, where the barrel pivots around a trunnion 1.2. Mounted on a shell-delivery arm 2.2 that also pivots around trunnion 1.2 is a shell rammer.

The base of the shell rammer consists of a rack 3. Fastened to rack 3 is a track 5. A cradle 4 travels, paralleling the axis R of the barrel's bore, on bearings along track 5. Cradle 4 is coupled to a piston-and-cylinder mechanism 6 that accelerates it in direction B. Extending along cradle 4 is a shock absorber 7. Shock absorber 7 accommodates a piston rod 7.2. Mounted on the end of piston rod 7.2 that extends downstream out of cradle 4 is a stop 7.3. The shell 8 that is to be rammed in is resting on cradle 4. At the upstream end of cradle 4 is a structure 4.1 that engages the shell. FIG. 1 illustrates cradle 4 with shell 8 in the starting positions, before being accelerated. In this state, cradle 4 is upstream and stop 7.3 is immediately behind barrel 1.

Details as to the construction of cradle 4 and shock absorber 7 can be obtained by way of example from EP 0 352 584 B1.

Figure 2:
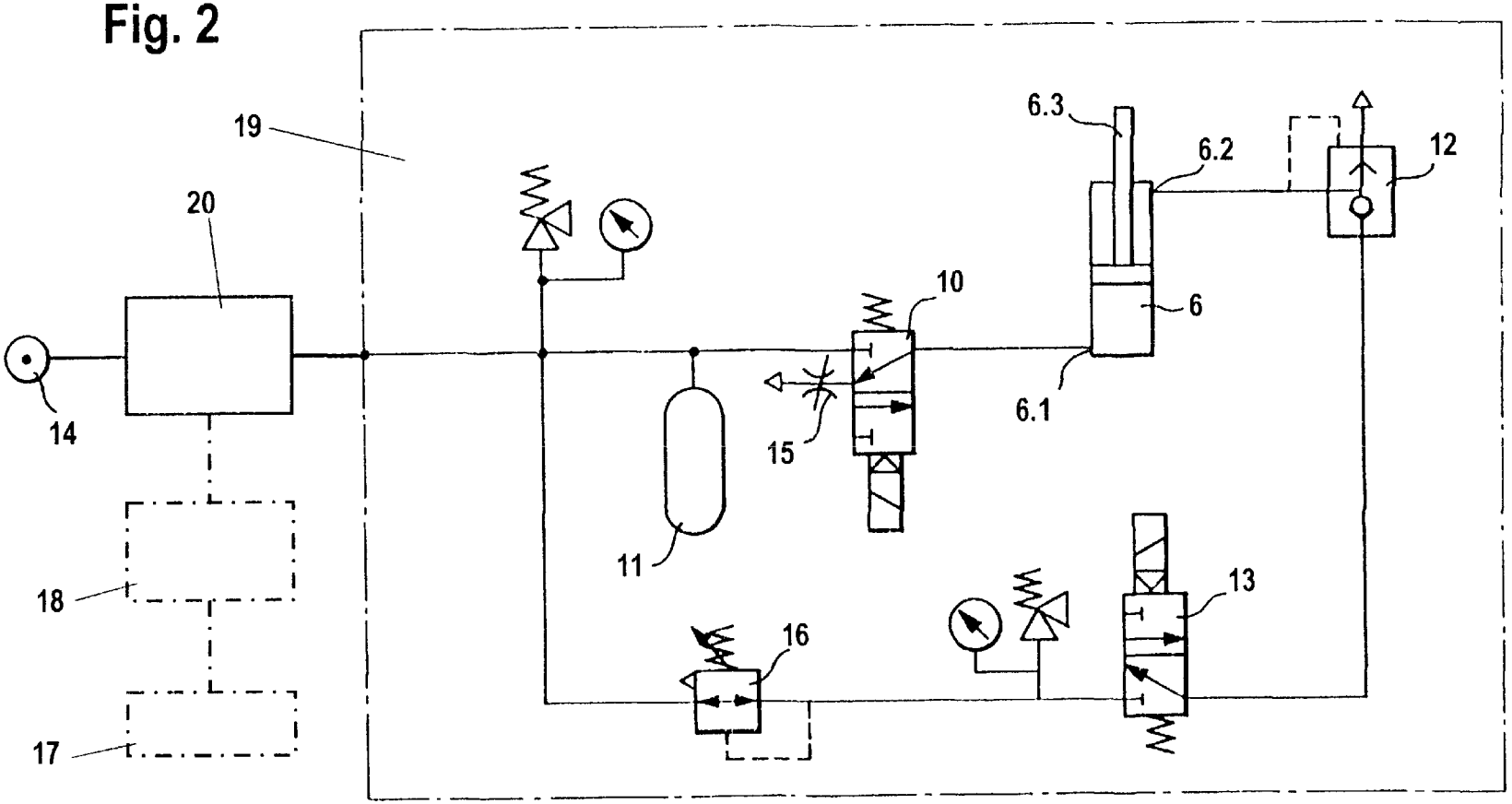
FIG. 2 is a wiring diagram of pneumatic controls for the rammer illustrated in FIG. 1.

Piston-and-cylinder mechanism 6 is actuated by the pneumatic controls 19 illustrated in detail in FIGS. 2 and rack 3. As will be evident from FIG. 2, the power-stroke port 6.1 of mechanism 6 communicates by way of an electromagnetic rapid-opening valve 10 with, on the one hand, a vent and, on the other, with the pressure-reduction component 20 to be specified in detail hereinafter and with a compressed-air reservoir 11. Pressure-reduction component 20 communicates conventionally with a source 14 of compressed air. The return-stroke port 6.2 of piston-and-cylinder mechanism 6 communicates by way of a rapid-opening evacuation valve 12 with, on the one hand, a vent and, on the other, by way of another electromagnet rapid-opening valve 13 and a pressure governor 16, with compressed-air reservoir 11 and with a vent. Valve 10 acts rapidly enough to ensure that enough fluid will always be forwarded on time to piston-and-cylinder mechanism 6. As acceleration is initiated, accordingly, sudden pressure will always be available to advance the piston and accelerate the cradle. The air on the other side of the piston will simultaneously be expelled through rapid-opening evacuation valve 12. Upon completion of the acceleration stroke, cradle 4 will be decelerated and returned to its original position, subject to the residual energy of shock absorber 7 or by connecting return-stroke port 6.2 to compressed-air reservoir 11 by way of rapid-opening valve 13 and pressure governor 16. In the former approach, shock absorber 7 can be provided for example with a friction spring, and piston-and-cylinder mechanism 6 will itself act as a shock absorber, the air being conveyed out through power-stroke port 6.1 and the appropriately adjusted rapid-opening valve 10 to a constriction 15.

Figure 3:
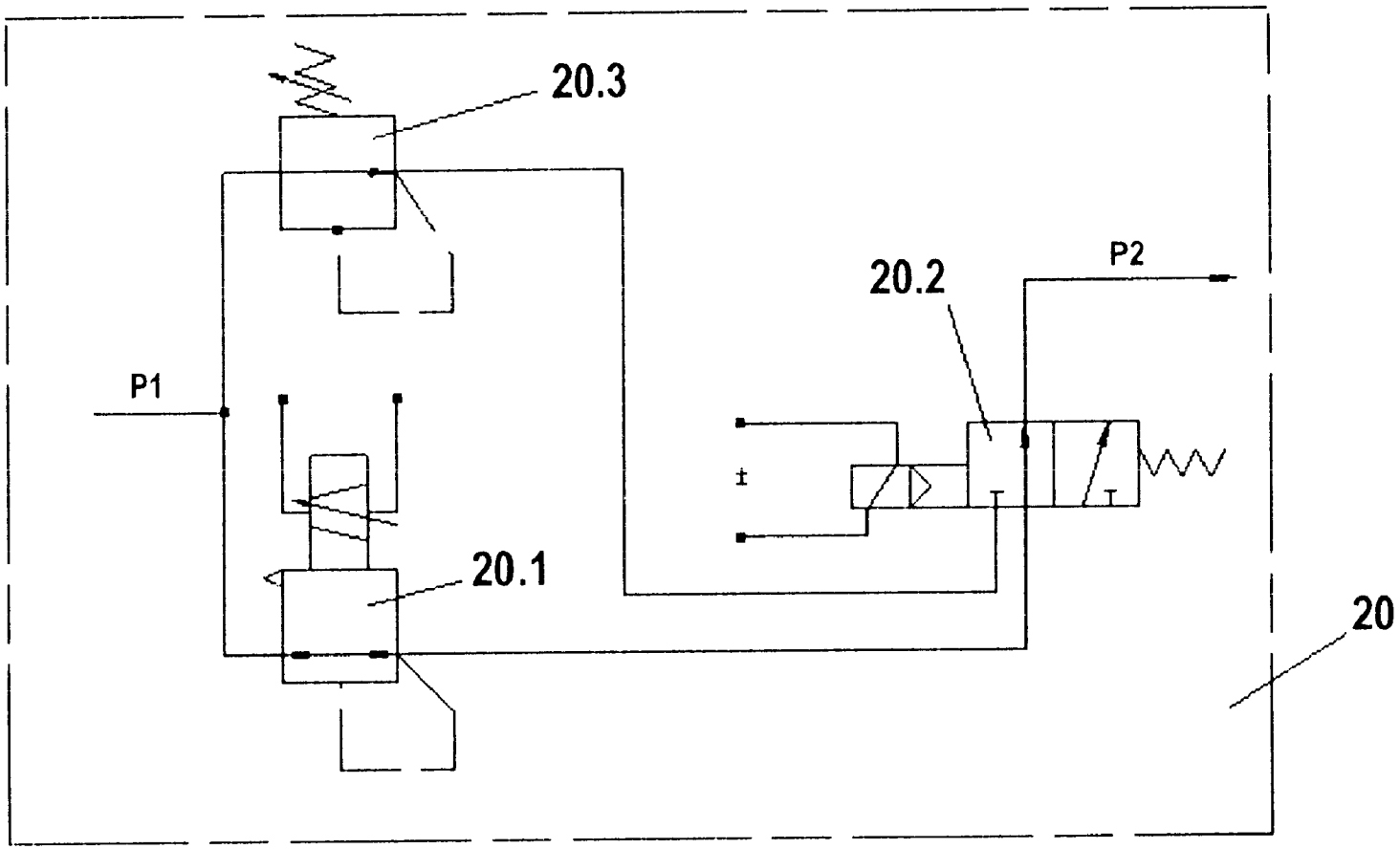
FIG. 3 is a detail of the pressure-reduction component of the pneumatic controls illustrated in FIG. 2.

Pressure-reduction component 20 is interposed between compressed-air source 14 and rapid-opening valve 10. As will be evident from FIG. 3, pressure reduction component 20 includes a proportional pressure-regulation valve 20.1. Valve 20.2 is controlled by electric controls 18. Signals representing a particular elevations of barrel 1 as calculated by a fire-direction system 17 or other position generator, the piece's angle generator for example, are forwarded to controls 18, reducing the ramming pressure as elevation decreases, and so doing in accordance with the formula hereinbefore described and to be specified hereinafter with reference to FIG. 4.

The pressure P1 at the intake into pressure-reduction component 20 is the pressure supplied by compressed-air source 14. The pressure P2 at the outlet equals the pressure reduced in accordance with elevation. As will be evident from FIG. 3, a manually actuated pressure-reduction valve 20.3 parallels pressure-regulation valve 20.1 inside pressure-reduction component 20. Valves 20.1 and 20.3 can be alternately connected to rapid-opening valve 10 by way of an electromagnetic alternating valve 20.2. When no air is flowing through it, in an emergency, that is, alternating valve 20.2 will connect manually actuated pressure-reduction valve 20.3 to a line leading to rapid-opening valve 10. In the event of a power failure, accordingly, when the component's controls no longer function, the pressure-reduction component can be operated on an emergency basis with the ramming pressure corresponding to any particular elevation being established manually by way of pressure-reduction valve 20.3.

Figure 4:
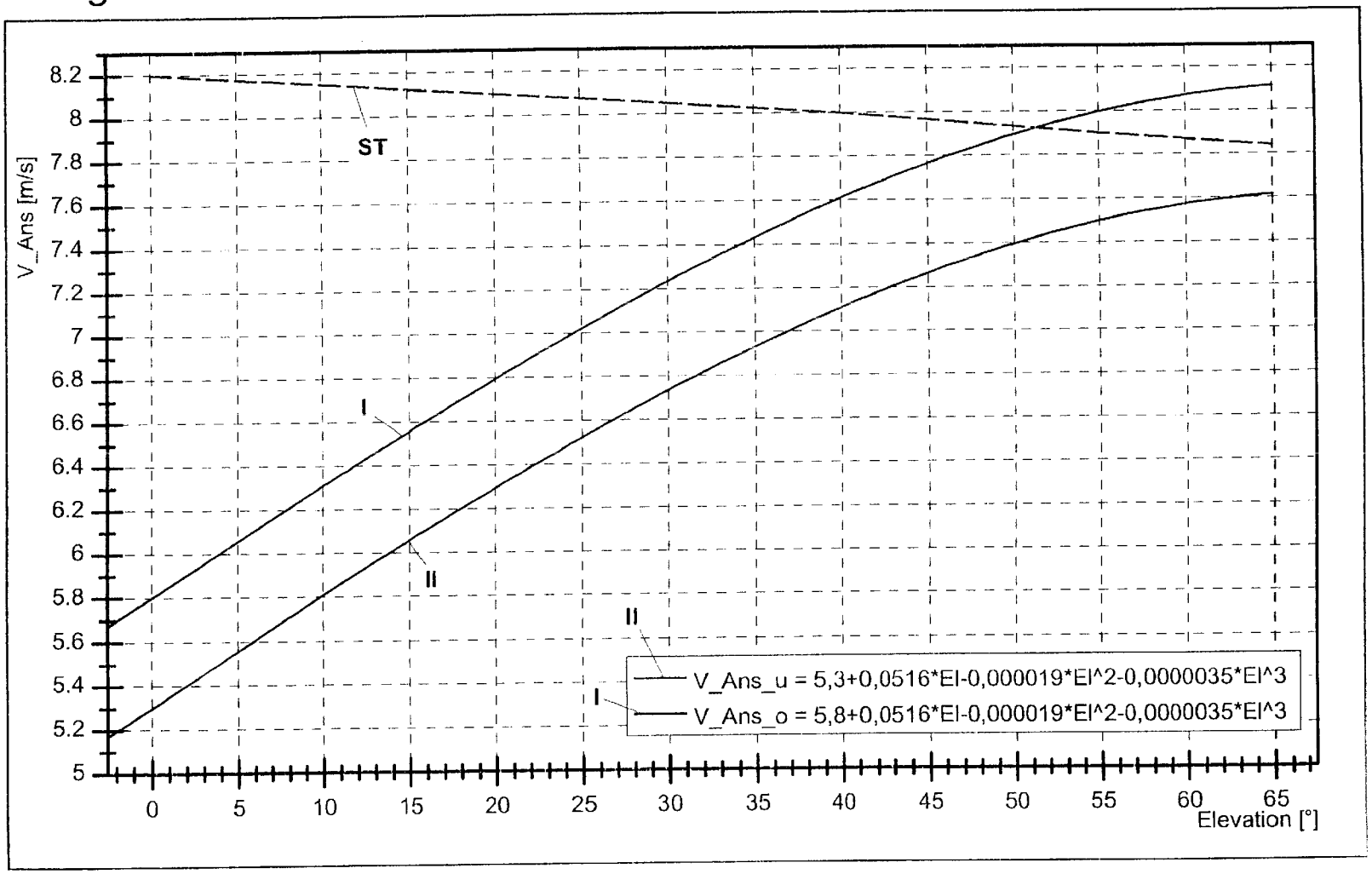
FIG. 4 is a graph illustrating ramming speed as a function of elevation at both the state of the art and in accordance with the present invention.

FIG. 4 is a graph illustrating ramming speed Vram as a function of elevation E.

Discontinuous curve ST represents ramming speed as a function of elevation in accordance with the state of the art, the same ramming pressure being employed for all elevations.

Curve I is a plot of the equation $$V_{ram}=5.8+0.0516\cdot E-0.000019\cdot E^2-0.0000035\cdot E^3$$

and

Curve II $$V_{ram}=5.3+0.0516\cdot E-0.000019\cdot E^2-0.0000035\cdot E^3.$$

Curves I and II define an upper and a lower limit for the range of permissible ramming speeds at particular elevations.

Tests have indicated that, when the ramming speeds depend on elevations within the specified ranges and in particular stay half-way between the two curves, ramming forces will remain almost constant through the whole range of elevations.

What is claimed is:

1. A rammer and artillery piece combination for use with artillery shells wherein said rammer and artillery piece combination comprises:

an artillery piece with a barrel that can be elevated, said barrel defining a first direction and having an upstream end;

a cradle having an accommodation for a shell with a structure at the upstream end of said cradle for engaging said shell, wherein said cradle is able to travel subject to a guide along a track in a direction that is parallel to said first direction defined by said barrel;

a piston-and-cylinder mechanism coupled to said cradle for accelerating said cradle in said first direction;

a braking mechanism that brakes said cradle at a prescribed distance from said upstream end of said barrel;

wherein said piston-and-cylinder mechanism is controlled by pneumatic controls that accommodate a rapid-opening valve, said valve diverting air back and forth between a source of compressed air and a vent;

further comprising a ramming pressure-reduction component with electrically controlled proportional pressure-regulation valve, said component interposed between said source of compressed air and said rapid-opening valve and operable to receive signals from a position generator, whereupon said pressure-regulation valve is activated and ramming pressure is reduced in accordance with a prescribed formula as the elevation of said barrel decreases.

2. The rammer and artillery piece combination of claim 1, wherein said ramming pressure is reduced with said elevation decrease in a way that the ramming speed ($V_{ram}$) depends on elevation (E) in accordance with the formula $$V_{ram}=A+B\cdot E-C\cdot E^2-D\cdot E^3,$$

wherein

A=5.3–5.8

B=0.0516

C=0.000019

D=0.0000035.

3. The rammer and artillery piece combination of claim 1, wherein a manually actuated pressure-reduction valve that parallels said proportional pressure-regulation valve is interposed between said source of compressed air and said rapid-opening valve and is employed in an emergency instead of said pressure-regulation valve in the event of a power failure.

4. The rammer and artillery piece combination of claim 3, wherein said proportional pressure-regulation valve and said pressure-reduction valve can be alternately connected to said rapid-opening valve by way of an electromagnetic alternating valve, whereby said alternating valve will connect to said pressure-reduction valve in the absence of electricity.

5. A rammer and artillery piece combination for use with artillery shells, wherein said rammer and artillery piece combination comprises:

an artillery piece with a barrel that can be elevated, said barrel defining a first direction and having an upstream end;

a cradle that is able to travel subject to a guide along a track in a defined direction;

a piston-and-cylinder mechanism coupled to said cradle for accelerating said cradle in said defined direction, said piston-and-cylinder mechanism being controlled by pneumatic controls that accommodate a rapid-opening valve that diverts air back and forth between a source of compressed air and a vent;

a braking mechanism that brakes and restricts the movement of said cradle at a defined point;

a ramming pressure-reduction component with electrically controlled proportional pressure-regulation valve, said component interposed between said source of compressed air and said rapid-opening valve, said pressure-reducing component operable to receive signals from a position generator and activating said pressure-regulation valve, thereby reducing ramming pressure in accordance with a prescribed formula.

6. The rammer and artillery piece combination of claim 5, wherein said ramming pressure is reduced in relation to a decrease in elevation of a barrel of said artillery piece in a way that the ramming speed ($V_{ram}$) depends on elevation (E) in accordance with the following formula:

$$V_{ram}=A+B\cdot E-C\cdot E^2-D\cdot E^3,$$

wherein

A=5.3–5.8

B=0.0516

C=0.000019

D=0.0000035.

7. The rammer and artillery piece combination of claim 5, wherein a manually actuated pressure-reduction valve that parallels said proportional pressure-regulation valve is interposed between said source of compressed air and said rapid-opening valve and is employed in an emergency instead of said pressure-regulation valve in the event of a power failure.

8. The rammer and artillery piece combination of claim 7, wherein said proportional pressure-regulation valve and said pressure-reduction valve can be alternately connected to said rapid-opening valve by way of an electromagnetic alternating valve, whereby said alternating valve will connect to said pressure-reduction valve in the absence of electricity.

* * * * *